US008251772B2

(12) United States Patent
Lin

(10) Patent No.: US 8,251,772 B2
(45) Date of Patent: Aug. 28, 2012

(54) METHOD FOR FORMING A BRASSIERE CUP

(76) Inventor: Mei Hui Lin, Changhua County (TW)

( * ) Notice: Subject to any disclaimer, the term of this patent is extended or adjusted under 35 U.S.C. 154(b) by 263 days.

(21) Appl. No.: 12/776,774

(22) Filed: May 10, 2010

(65) Prior Publication Data

US 2011/0275279 A1 Nov. 10, 2011

(51) Int. Cl.
*A41C 3/00* (2006.01)

(52) U.S. Cl. ..... 450/39; 450/54; 450/38; 2/267

(58) Field of Classification Search ..... 450/36–39, 450/54–57; 2/267, 268
See application file for complete search history.

(56) References Cited

U.S. PATENT DOCUMENTS 3,202,565 A * 8/1965 Loftin ..... 428/175
4,080,416 A * 3/1978 Howard ..... 264/258
4,172,002 A * 10/1979 Gluckin ..... 156/245
4,250,137 A * 2/1981 Riedler ..... 264/554
4,398,981 A * 8/1983 Ellis ..... 156/91
4,481,951 A * 11/1984 Cole et al. ..... 450/20
4,557,267 A * 12/1985 Cole ..... 450/40
5,820,443 A * 10/1998 Burr ..... 450/40
5,967,877 A * 10/1999 Howard ..... 450/57
6,837,771 B2 * 1/2005 Falla ..... 450/39
7,214,121 B1 * 5/2007 Huang ..... 450/39
7,682,219 B2 * 3/2010 Falla ..... 450/92

* cited by examiner

*Primary Examiner* — Gloria Hale
(74) *Attorney, Agent, or Firm* — Muncy, Geissler, Olds & Lowe, PLLC

(57) ABSTRACT

A method for forming a brassiere cup includes the steps of: forming an inner cup member and an outer cup member of the brassiere cup, respectively; spraying or coating the predetermined joining surfaces of the inner and outer cup members with a glue; heating a film and, while the film is softened, attaching it to the glue-sprayed or glue-coated surfaces of the inner and outer cup members by vacuum suction; and assembling and sealing the inner and outer cup members and filling a filler in between the inner and outer cup members. The filler in the brassiere cup thus formed can comply with the breast shape of each user to achieve optimal shaping and supporting effects.

10 Claims, 2 Drawing Sheets

METHOD FOR FORMING A BRASSIERE CUP

BACKGROUND OF THE INVENTION

1. Technical Field

The present invention relates to a method for forming a brassiere cup. More particularly, the present invention relates to a method by which the predetermined joining surfaces of formed inner and outer cup members are sprayed or coated with a glue, a film is heated and attached to the glue-sprayed or glue-coated surfaces of the inner and outer cup members by vacuum suction, the inner and outer cup members are assembled and sealed to form the brassiere cup, and a filler is filled in between the inner and outer cup members, wherein the filler in the brassiere cup can conform to the breast shape of each user to achieve optimal shaping and supporting effects.

2. Description of Related Art

Brassieres, or bras for short, are commonly used for supporting as well as shaping the breasts. The cups of a shaping bra are usually sewn with padding or are specially molded so as to form raised portions that modify the breast shape by providing enhanced support for certain parts of a user's breasts. However, as the raised portions are fixed in position and not suitable for all breast shapes, the ideal shaping effect is often unattainable. As an improvement, there are bras with movable pads which can be moved to the desired locations to suit each user's need. Nevertheless, the pads tend to displace and therefore lose their intended supporting or shaping functions due to excessive body movement. Furthermore, the pads, fixed or movable, are provided only in certain parts of the brassiere cups and act only on the breast portions to which they are adjacent; in other words, the shaping effects of these pads on the other portions of the breasts are unknown.

Another kind of shaping bras involves an inflatable sac provided between the inner and outer cup members of each cup, and a built-in pump is manually pressed to inflate the sacs to the desired height. However, these inflatable sacs, be they fixed or movable, have the same problems as the foregoing pads when incorporated into bras. Moreover, bras with such inflatable sacs are disadvantaged by inconvenient of use, the feel of a foreign object (due to the pump), and difficult maintenance.

BRIEF SUMMARY OF THE INVENTION

As the conventional shaping bras more or less have the aforementioned drawbacks, and the ideal shaping bra is supposed to automatically comply with the breast shape of each user, it is an object of the present invention to provide an improvement over the prior art.

To solve the foregoing problems of the conventional shaping bras, the present invention provides a brassiere cup formed by a special method. The method includes the steps of: forming an inner cup member and an outer cup member of the brassiere cup, respectively; spraying or coating the predetermined joining surfaces of the inner and outer cup members with a glue; heating a film and, while the film is softened, attaching it to the glue-sprayed or glue-coated surfaces of the inner and outer cup members by vacuum suction; and assembling and sealing the inner and outer cup members and filling a filler in between the inner and outer cup members.

In the brassiere cup formed by the method of the present invention, the area covered by the films is close to the entire area of the cup (excluding the pressed edge along the periphery of the cup), and in consequence, the area occupied by the filler is also close to the entire area of the cup. The comprehensive support provided by the filler is unachievable by the pads of conventional brassieres.

Furthermore, the filler in the brassiere cup formed according to the present invention can flow or move under the action of an external force. Therefore, during use, when a particular portion of the cup is compressed by a prominent part of the breast, the filler is squeezed toward the uncompressed or less compressed portion of the cup. As the less compressed portion of the cup usually corresponds in position to the less prominent part of the breast, the portion of the filler that moves to this area provides timely support for the less prominent part and hence full support for the breast, thereby elevating the breast in a natural way.

In the method of the present invention, the inner and outer cup members are sealed before the filler is injected in between the inner and outer cup members through an inlet opening. Alternatively, the filler is disposed directly in the outer cup member before the inner cup member is placed on and sealed to the outer cup member.

Preferably, the film used in the method of the present invention is an air-impermeable film such as TPU, TPE, PVC, and like thermoplastic films, while the filler is one of silicone, oil, water, air, cream, paste, gel, elastomer, TPR/TPE, powder, foamed particles, and so on. However, the film may also be air-permeable. For instance, the film can be an aforementioned air-impermeable film formed with air-penetrable pores or an air-permeable material such as cotton cloth. When an air-permeable film is used, with a view to increasing breathability of the brassiere, the particle size of the filler, such as foamed particles, must be larger than the pore size of the film material.

BRIEF DESCRIPTION OF THE SEVERAL VIEWS OF THE DRAWINGS

A detailed description of further technical features of the present invention is given below by reference to a preferred embodiment in conjunction with the accompanying drawings, in which:

FIGS. 1B and 1C schematically show the step of spraying or coating one surface of each of the inner and outer cup members with a glue; FIG. 1D schematically shows the process of attaching a film to the glue-sprayed or glue-coated surface of either the inner or outer cup member by vacuum suction; FIG. 1E is a sectional view of the inner or outer cup member after completion of the step depicted in FIG. 1D, showing particularly the film attached to the glue-sprayed or glue-coated surface; and FIG. 1F schematically shows the inner and outer cup members sealed to each other, with a filler filled therebetween.

DETAILED DESCRIPTION OF THE INVENTION

Figure 1A:
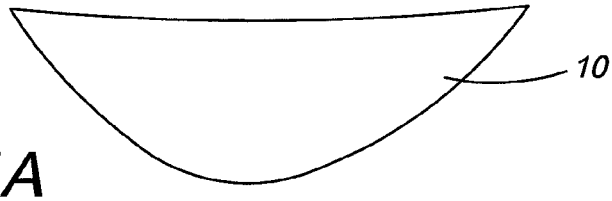
FIGS. 1A to 1F show the steps, and their respective products, of a method for forming a brassiere cup according to a preferred embodiment of the present invention, wherein FIG. 1A schematically shows the step of forming an inner or outer cup member.
Figure 1B:
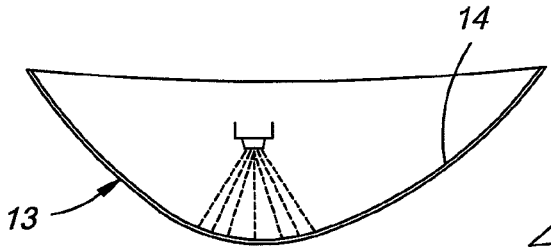
Figure 1C:
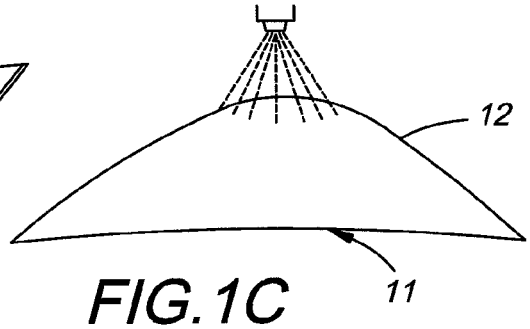
Figure 1D:
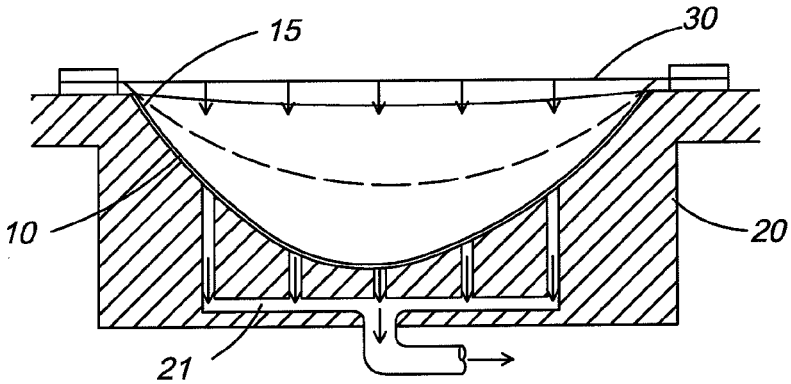
Figure 1E:
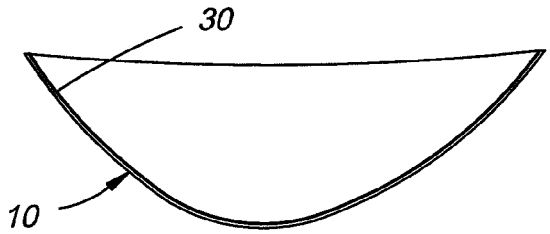
Figure 1F:
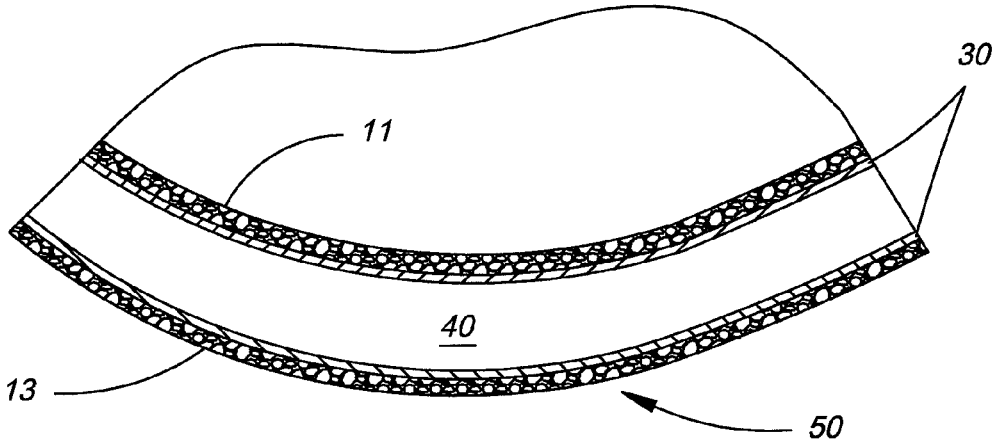

Referring to FIGS. 1A to 1F, a method for forming a brassiere cup according to a preferred embodiment of the present invention includes the steps of: forming an inner cup member and an outer cup member of the brassiere cup, respectively (FIG. 1A); spraying or coating the predetermined joining surfaces of the inner and outer cup members with a glue (FIGS. 1B and 1C); heating a film and, while the film is softened, attaching the film to the glue-sprayed or glue-coated surfaces of the inner and outer cup members by vacuum suction (FIGS. 1D and 1E); and assembling and sealing the inner and outer cup members and filling a filler in between the inner and outer cup members (FIG. 1F).

The inner and outer cup members are formed by a conventional brassiere-cup forming process. Typically, a foam material is hot-pressed by a mold to form a single cup member 10 or the left and right cups of a brassiere. The formed cup member is cut into a unit having substantially the final shape. Alternatively, the formed cup member is cut after the film is attached thereto or after assembly with the corresponding inner or outer cup member.

In the step of spraying or coating the predetermined joining surfaces of the inner and outer cup members with a glue, the predetermined joining surfaces refer to the surfaces of the inner and outer cup members that face and are attached to each other when assembled. The predetermined joining surface of the inner cup member 11 shown in FIG. 1C is the outwardly convex surface 12; the predetermined joining surface of the outer cup member 13 shown in FIG. 1B is the inwardly concave surface 14. The spraying or coating of the glue is preferably implemented by placing the cup member in a mold for stable support. As to the choice of the glue, those commonly used in the art, such as water-based glue, oil-based glue, and hot glue, are all eligible.

The glue-sprayed or glue-coated cup member is transferred to the mold 20 of a vacuum suction forming machine, as shown in FIG. 1D. Then, a thermoplastic film 30 selected from TPU, TPE, and PVC is placed above the glued surface 15 of the cup member 10 and heated. While the film is softened, as indicated by the dashed line in FIG. 1D, a vacuum operation is activated to draw air out of the air ducts 21 in the mold 20 and thereby produce a vacuum effect. As a result, the film is attached to the glue-sprayed or glue-coated surface 15 of the cup member 10. According to known vacuum suction experiences, the film 30 will be shaped along and attached smoothly to the glue-sprayed or glue-coated surface 15 of the cup member 10. Besides, due to the glue sprayed or coated in advance, the film when cooled adheres securely to the predetermined joining surface of the cup member without excessive shrinkage, as shown in FIG. 1E. Moreover, the film will not peel off because of insufficient bonding strength.

After the film is attached to each of the inner and outer cup members, the inner and outer cup members are aligned and assembled into one unit by a thermal bonding technique such as high-frequency bonding, thermal bonding, or ultrasonic bonding. To facilitate the execution of this step, the inner and outer cup members may be provided in advance with punch holes, marks, or other positioning reference points during their respective forming processes, so as to be precisely and conveniently assembled. While the inner and outer cup members are hot-pressed together, an inlet opening (not shown) is reserved, as is conventional, to allow the injection of a filler 40 into the space surrounded by the two films 30 on the inner and outer cup members 12, 13, as shown in FIG. 1F. In the present embodiment, the filler 40 is selected from materials well known in the art such as silicone, oil, water, air, cream, gel, elastomer, paste, TPR/TPE, powder, foamed particles, and so on. After the filling process is complete, the inlet opening is hot-pressed, and the assembly trimmed to shape. Thus, the brassiere cup 50 shown in FIG. 1F is formed and is subsequently integrated into a brassiere by a known brassiere manufacturing process. It should be pointed out that formation of the inlet opening may be omitted in the step of filling the filler. In that case, the filler is directly put in the outer cup member before the inner cup member is placed on the outer cup member and sealed thereto.

Figure 2:
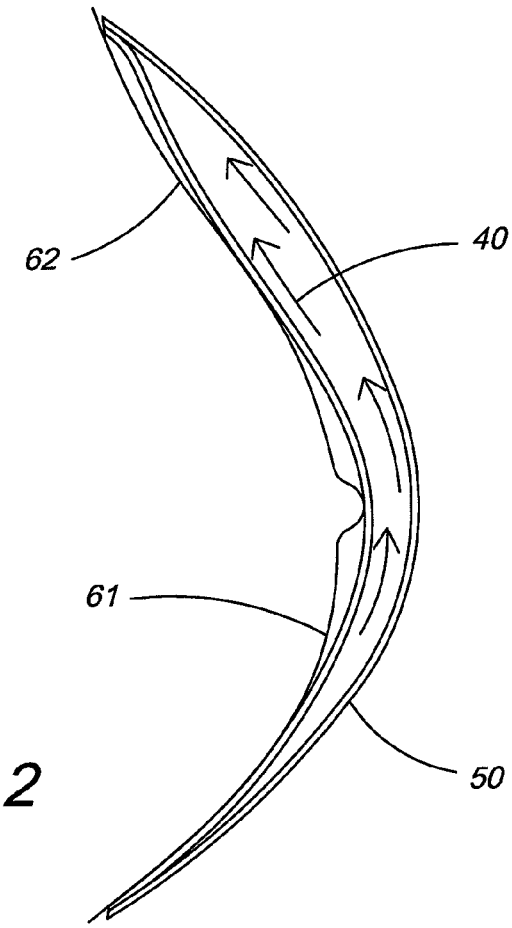
FIG. 2 shows application of the brassiere cup formed by the method of the present invention, wherein the filler flows or moves to support the user's breast.

When the brassiere cup formed by the method of the present invention is incorporated into a brassiere, and the brassiere is worn by a user, the filler 40 in the cups 50 will move or flow under compression of the user's breasts, as explained below. Referring to FIG. 2, the filler 40 is compressed by the relatively prominent (or convex) part 61, but not the relatively less prominent (or concave) part 62, of the breast. As a result, the filler moves in the space between the two films of the brassiere cup. More specifically, the filler under compression moves toward the uncompressed portion of the cup (as indicated by the arrows in FIG. 2) such that a larger portion of the filler accumulates where the concave part 62 of the breast is, thereby providing more support for that part of the breast. Hence, while the inner and outer cup members of the brassiere cup formed by the method of the present invention have a fixed external configuration, as do the conventional brassiere cups, the internal structure of the brassiere cup formed according to the present invention provides full and compliant support for a user's breasts, thereby overcoming the drawbacks of the conventional brassiere cups such as undue compression and insufficient support, allowing better fit, and elevating the breasts in a more natural way.

The embodiment described above is provided only to demonstrate the preferred mode of implementation but not to limit the scope of the present invention. A person of ordinary skill in the art may, after reviewing the technical contents disclosed herein, change or modify the foregoing embodiment without departing from the spirit of the present invention. The scope of the present invention is defined only by the appended claims.

What is claimed is:

1. A method for forming a brassiere cup, comprising steps of:

forming an inner concave-convex cup member and an outer concave-convex cup member of the brassiere cup, respectively;

spraying or coating the outwardly convex surface of the inner cup member and the inwardly concave surface of the outer cup member with a glue;

heating a heat soften able film with the heat necessary to soften said heat soften able film and attaching said heat softened film to said glue sprayed or coated surfaces of the inner and outer cup members by vacuum suction; and while leaving an opening, assembling and sealing the inner and outer cup members and filling a filler into a space between the inner and outer cup members.

2. The method of claim 1, wherein the film is a thermoplastic film selected from the group consisting of thermoplastic polyurethane, thermoplastic elastomers, and polyvinyl chloride.

3. The method of claim 2, wherein the filler is one of silicone, oil, water, air, cream, elastomer, paste, gel, thermoplastic rubber/thermoplastic elastomers, powder, and foamed particles.

4. The method of claim 1, wherein the film is an air-permeable film having pores, and the filler has a particle size larger than a pore size of the pores of the film.

5. A method for forming a brassiere cup, comprising steps of:

forming an inner concave-convex cup member and an outer concave-convex cup member of the brassiere cup, respectively;

spraying or coating the outwardly convex surface of the inner cup member and the inwardly concave surface of the outer cup member with a glue;

heating a heat soften able film with the heat necessary to soften said heat soften able film and attaching said heat softened film to said glue sprayed or coated surfaces of the inner and outer cup members by vacuum suction; and disposing a filler in the outer cup member, placing the inner cup member on the outer cup member, and sealing the inner and outer cup members.

6. The method of claim 5, wherein the film is a thermoplastic film selected from the group consisting of thermoplastic polyurethane, thermoplastic elastomers, and polyvinyl chloride.

7. The method of claim 6, wherein the filler is one of silicone, oil, water, air, cream, elastomer, paste, gel, thermoplastic rubber/thermoplastic elastomers, powder, and foamed particles.

8. The method of claim 5, wherein the film is an air-permeable film having pores, and the filler has a particle size larger than a pore size of the pores of the film.

9. The method of claim 1, wherein the inner cup member and the outer cup member are formed of a foam material.

10. The method of claim 5, wherein the inner cup member and the outer cup member are formed of a foam material.

* * * * *